US009975145B2

(12) United States Patent
Lei et al.

(10) Patent No.: US 9,975,145 B2
(45) **Date of Patent: *May 22, 2018**

(54) PULSE AMPLITUDE CONTROLLED CURRENT SOURCE FOR ULTRASOUND TRANSMIT BEAMFORMER AND METHOD THEREOF

(71) Applicant: Microchip Technology Inc., Chandler, AZ (US)

(72) Inventors: Jimes Lei, Milpitas, CA (US); Ching Chu, San Jose, CA (US)

(73) Assignee: Microchip Technology Inc., Chandler, AZ (US)

( * ) Notice: Subject to any disclaimer, the term of this patent is extended or adjusted under 35 U.S.C. 154(b) by 886 days.

This patent is subject to a terminal disclaimer.

(21) Appl. No.: 14/045,689

(22) Filed: Oct. 3, 2013

(65) Prior Publication Data

US 2015/0098307 A1 Apr. 9, 2015

Related U.S. Application Data

(60) Provisional application No. 61/731,390, filed on Nov. 29, 2012.

(51) Int. Cl.
*B06B 1/02* (2006.01)

(52) U.S. Cl.
CPC ..... *B06B 1/0215* (2013.01)

(58) Field of Classification Search
CPC ..... B06B 1/0215
See application file for complete search history.

(56) References Cited

U.S. PATENT DOCUMENTS 8,198,922 B1 * 6/2012 Chu ..... B06B 1/023 327/112
8,638,003 B2 * 1/2014 Hashimoto ..... F02D 29/06 290/27
8,648,627 B1 * 2/2014 Chu ..... G10K 11/346 327/106
8,933,613 B2 * 1/2015 Amemiya ..... G01N 29/34 310/316.03
2009/0206676 A1 * 8/2009 Chu ..... B06B 1/0215 307/106
2012/0068739 A1 * 3/2012 Horbach ..... H03K 7/08 327/109
2012/0294050 A1 * 11/2012 Hashimoto ..... F02D 29/06 363/37
2013/0104658 A1 * 5/2013 Amemiya ..... G01N 29/34 73/606
2013/0187697 A1 * 7/2013 Choy ..... H03K 17/6872 327/298
2013/0310689 A1 * 11/2013 Nishigaki ..... A61B 8/4483 600/437

(Continued)

*Primary Examiner* — Daniel Pihulic
(74) *Attorney, Agent, or Firm* — Burr & Forman LLP; Ryan M. Corbett

(57) ABSTRACT

An electrical waveform generating circuit has a pair of Pulse Amplitude Controlled Switching Current Sources (PACS). A gate pulse driver circuit is coupled to an input of each of the pair of PACS for sending gate pulses for driving the pair of PACS. A digital-to-analog converter (DAC) circuit is coupled to the gate pulse driver circuit for controlling amplitudes of the gate pulses. A transducer is coupled to the PACS.

14 Claims, 5 Drawing Sheets

(56) References Cited

U.S. PATENT DOCUMENTS

2014/0049299 A1* 2/2014 Chu ..... G10K 11/346
327/129
2015/0098307 A1* 4/2015 Lei ..... B06B 1/0215
367/137

* cited by examiner

Fig. 6 – Prior Art

PULSE AMPLITUDE CONTROLLED CURRENT SOURCE FOR ULTRASOUND TRANSMIT BEAMFORMER AND METHOD THEREOF

RELATED APPLICATION

The present application is related to U.S. Provisional Application entitled, "PULSE AMPLITUDE CONTROLLED CURRENT SOURCE FOR ULTRASOUND TRANSMIT BEAMFORMER AND METHOD", Filed Nov. 29, 2012, and having U.S. Ser. No. 61/731,390 in the name of the same inventors and further related to U.S. Patent Application entitled, "Ultrasound Transmit Beamformer Integrated Circuit and Method", Filed May 6, 2010, and having U.S. Pat. No. 8,198,922B1 which is incorporated herein by reference in its entirety. The present patent application claims the benefit under 35 U.S.C. § 119(e).

TECHNICAL FIELD

This invention relates generally to a programmable ultrasound transmit beamformer waveform generator, and more particularly, to an ultrasound pulse waveform generator circuit and method with waveform and transmitting sequence control data memory for driving a piezoelectric transducer array probe for transmit beamforming and dynamic focusing.

BACKGROUND

Ultrasound array transmitters in medical or nondestructive testing (NDT) imaging application have a growing demand for more sophisticated electrical excitation waveforms to generate well-focused, high resolution targeted, coherently formed, high frequency acoustic dynamic scanning beams. The conventional ultrasound beamforming transmit pulse generator circuit generally require a digital interface to Field-Programmable Gate Array (FPGA) or logic I/Os which are usually in low voltage areas, and an output MOSFETs stage which generally has to be in a high voltage area. Many control signals generally have to cross the low voltage to high voltage isolation barrier. Among these signals, some of the signals can be in digital form and some can be in analog form. Further, due to increasing demand of high resolution in current or voltage or in time, the number of signals is generally increasing. Thus, the die area for the signal translation integrated circuit is becoming increasingly higher in cost.

Therefore, a need exists to provide a device and method to overcome the above problem.

SUMMARY

An electrical waveform generating circuit has a pair of Pulse Amplitude Controlled Switching Current Sources (PACS). A gate pulse driver circuit is coupled to an input of each of the pair of PACS for sending gate pulses for driving the pair of PACS. A digital-to-analog converter (DAC) circuit is coupled to the gate pulse driver circuit for controlling amplitudes of the gate pulses. A transducer is coupled to the PACS.

An electrical waveform generating circuit has a programmable switch current source-driver. A plurality of Pulse Voltage Amplitude Controlled Switching Current Source (PACS) is configured into a high voltage complementary P- and N-type MOSFETs formed common-gate power amplifier. A pair of complementary digital programmable voltage amplitude gate-driver capacitive circuits is coupled to inputs of the PACS for controlling the output current waveforms and timing. A transducer is coupled to drains of the complementary P- and N-type MOSFETs.

An electrical waveform generating circuit has a pulse voltage amplitude control switching current source circuit. A pair of switching control circuits is coupled to a floating source-driver and control circuit. A plurality of complementary P- and N-type MOSFETs is coupled to the pair of switching control circuits. A transducer is coupled to the complementary P- and N-type MOSFETs.

An electrical waveform generating circuit has a transducer. A pair of MOSFETS is provided, wherein the pair of MOSFEST comprises a P-type and N-type MOSFET, the transducer coupled to sources of the P-type and N-type MOSFETs.

The features, functions, and advantages may be achieved independently in various embodiments of the disclosure or may be combined in yet other embodiments.

BRIEF DESCRIPTION OF DRAWINGS

The novel features believed to be characteristic of the disclosure are set forth in the appended claims. In the descriptions that follow, like parts are marked throughout the specification and drawings with the same numerals, respectively. The drawing FIGURES are not necessarily drawn to scale and certain FIGURES can be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure, In various embodiments, the waveform generators of the present invention provide ultrasound imaging probe transducer excitation using a large number array of high voltage and high current transmit pulse waveform generators that may be controlled by a digital logic interface directly with fast response and precise timing. Electronics controlled dynamic focus, acoustic phase-array, and transmitting beamforming technology may be used in color Doppler image portable ultrasound machines. In various embodiments, the waveform generators of the present invention provide digital controlled, programmable high voltage waveform multiple generator channels that are integrated into very small ICs. In various embodiments, the waveform generators of the present invention may generate various transmitting waveforms, and include only two complementary high current output stage MOSFETs.

Figure 1:
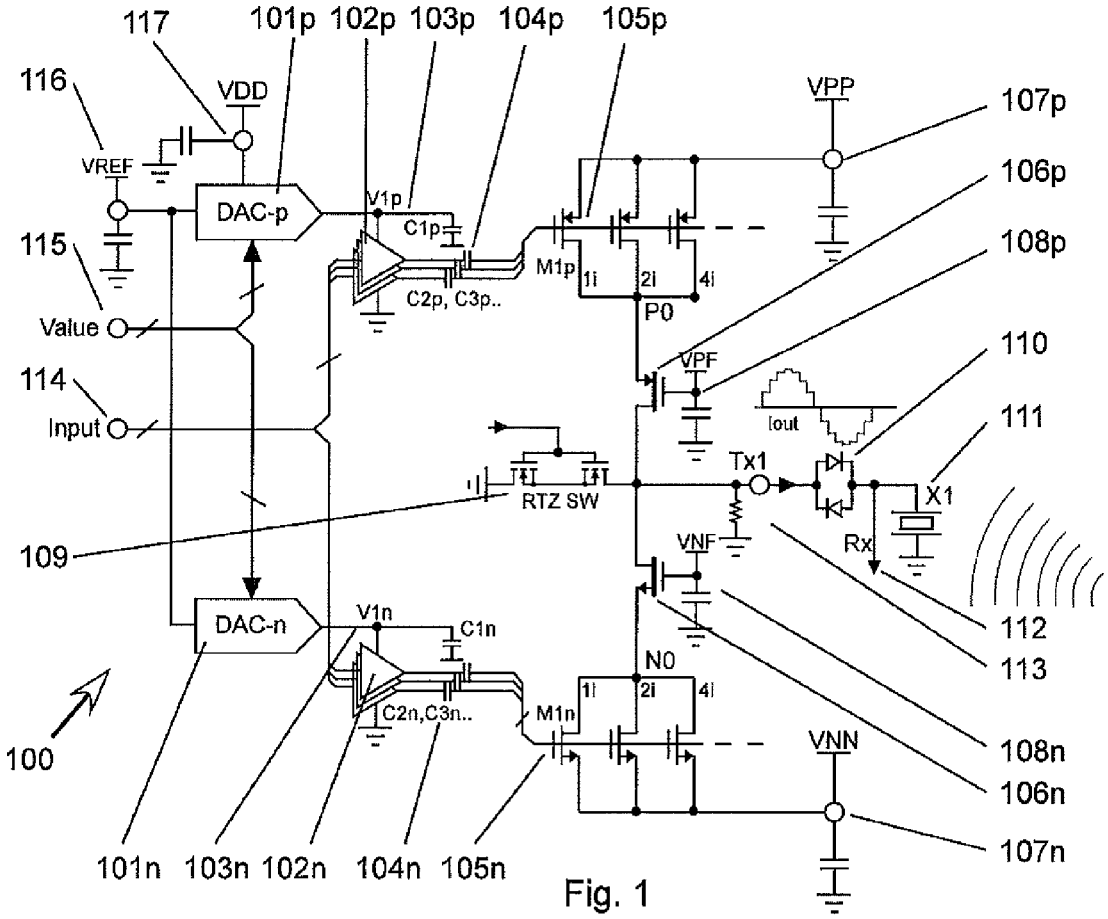
FIG. 1 is a schematic diagram illustrating a high voltage waveform generator circuit that includes a transformer-less complementary source-driving current-source pulse amplitude modulation and voltage amplifier stage for ultrasound transmit excitation applications in accordance with one embodiment of the present invention.

Referring to FIG. 1, a schematic block diagram illustrating the transformer-less waveform generator circuit 100 (hereinafter circuit 100) of the present invention is shown. The circuit 100 may have a pair of Pulse Amplitude Controlled Switching-Current-Source (PACS) source-drivers, 105*p* at the high-side and 105*n* at the low-side. In accordance with one embodiment of the present embodiment, an input of the PACS source-driver 105*p* may be driven by a gate pulse driver circuit 102*p* while an input of the PACS source-driver 105*n* may be driven by a gate pulse driver circuit 102*n*. The gate pulse driver circuits 102*p* and 102*n* may be controlled by DAC-p 101*p* and DAC-n 101*n*, respectively, and clouded capacitively via 104*p* and 104*n*, respectively, across the high voltage barrier. The input 114 receives timing control logic signals which may be high speed switching-current sources on or off control signals. Each of the timing control logic signals may correspond to the weighting of the switching current sources 1*i*, 2*i*, 4*i* and etc. on top and bottom of the circuit. The sum of these switching current sources may be feed into the common-gate power amplifiers 106*p* and 106, which are high voltage P and N-MOSFET.

The gates of the high voltage P- and N-type MOSFETs 106*p* and 106*n*, respectively, may be connected to a voltage VPF 108*p* and VNF 108*n* respectively as DC bias voltages. However, they are grounded for Alternating Current (AC) or Radio Frequency (RF) point of view.

The DC bias voltages VPF 108*p* and VNF 108*n* and the gate threshold of the P- and N-type MOSFETs 106*p* and 106*n* have been selected such when P0 and N0 are off, both P- and N-type MOSFETs 106*p* and 106*n* will be turned off, when the voltage of P0 are high or N0 or low to a reasonable level, the current of the high voltage P- or N- type MOSFETs 106*p* or 106*n* can be predetermined value as the maximum.

The current from the maximum to zero level may be linearly or almost linearly controlled by the (PACS) source-drivers 105*p* and 105*n* according to their gate switching pulse voltage amplitude when they are turned on, which is according the full-scale current DACs 101*p* and 101*n* settings. The DAC digital to analog converter is controlled by the digital value 115.

The timing control logic signals sent to the input 114 of the circuit 100 are the pulse timing data of the transmitting operation. This timing input digital signal bus width is matched to the P0 and N0 current-sources summing weights numbers.

Figure 6:
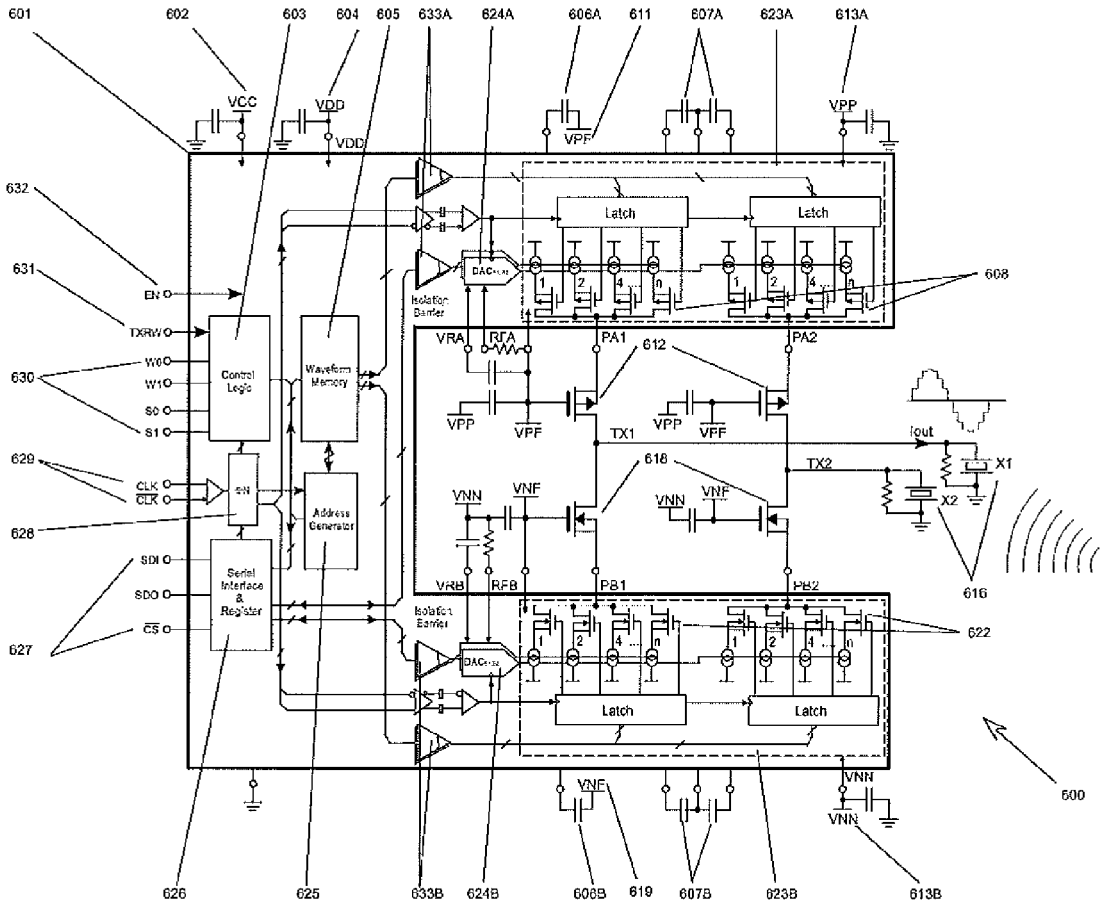
FIG. 6 is the prior art of schematic diagram illustrating a waveform generator circuit including a push-pull source-driving current-source pulse amplitude and width modulations, vector angle lookup table and voltage amplifier stage configuration, in this case a magnetic transformer or coupled-inductor must be used.
Figure 7:
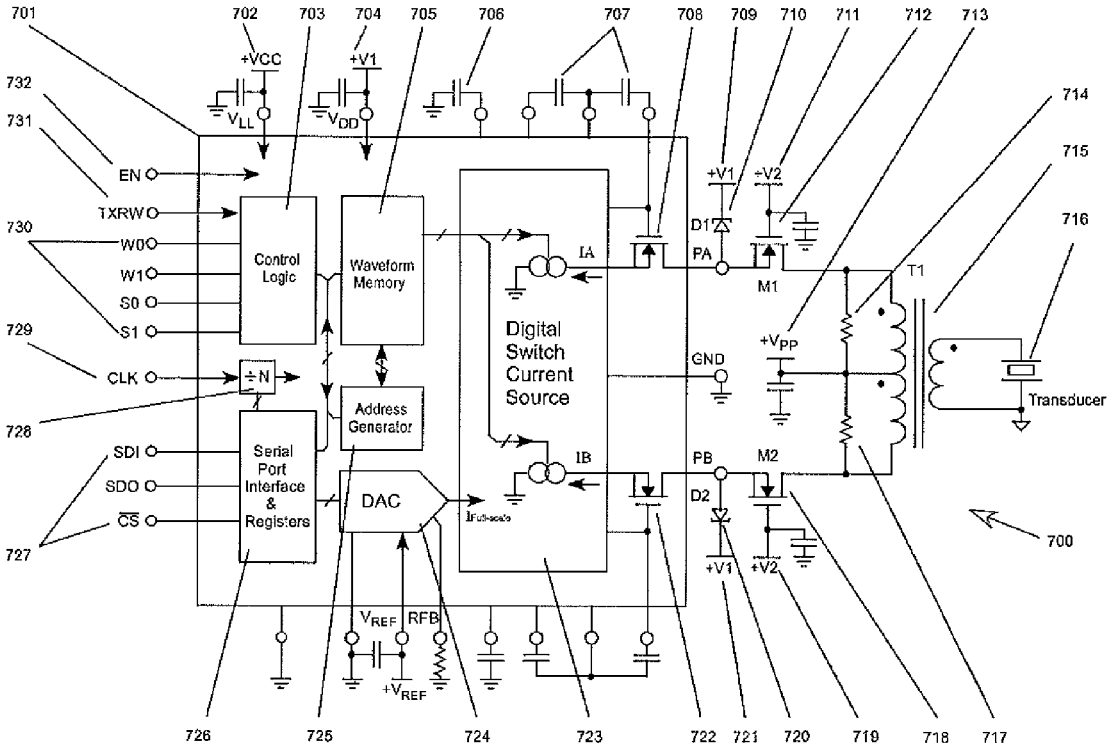
Fig. 7 Prior Art-2
FIG. 7 is a schematic diagram illustrating a high voltage waveform generator circuit that includes a transformer-less complementary source-driving current-source pulse amplitude modulation and voltage amplifier stage for ultrasound transmit excitation applications in accordance with the prior art, in this case the current-amplitude setting information sending across the isolation barrier is in digital format, therefore the high speed digital circuit must be present on both the positive high voltage and negative-high voltage's "high-side".

The high voltage P- and N-type MOSFETs 106*p* and 106*n* drains may be connected together to the load piezoelectric or capacitive ultrasound transducer 111. There is no need of a RF current transformer like the RF current transformer 615 shown in FIG. 6. The high voltage power supply 107*p* and 107*n* may be connected to the source of the PACS circuit 105*p* at the top, and to the source of the PACS circuit 105*n* at the bottom respectively.

In accordance with one embodiment of the present invention, The voltage supply of the circuit VDD=+5V and VPP/VNN=±15V to ±100V fixed power supplies, and (VPP-VPF)=+5V, (VNF-VNN)=+5V floating power supplies typically.

A pair of back-to-back coupled MOSFETs 109 is connected to the drains of the high voltage P- and N-type MOSFETs 106*p* and 106*n* summing point to the ground forming an output return-to-zero (RTZ SW) switch 109. A resistor 113 may be coupled to the RTZ SW switch 109. The resistor 113 is a bleeding resistor for transmit output for discharging any residue leakage current the circuit 100 may have.

The output of the circuit 100 via the back-to-back cross coupled diode circuit 110 may further be coupled to a piezoelectric or capacitive transducer 111 and further may be coupled to an ultrasound echo receiving circuit input(s) Rx 112.

Figure 2:
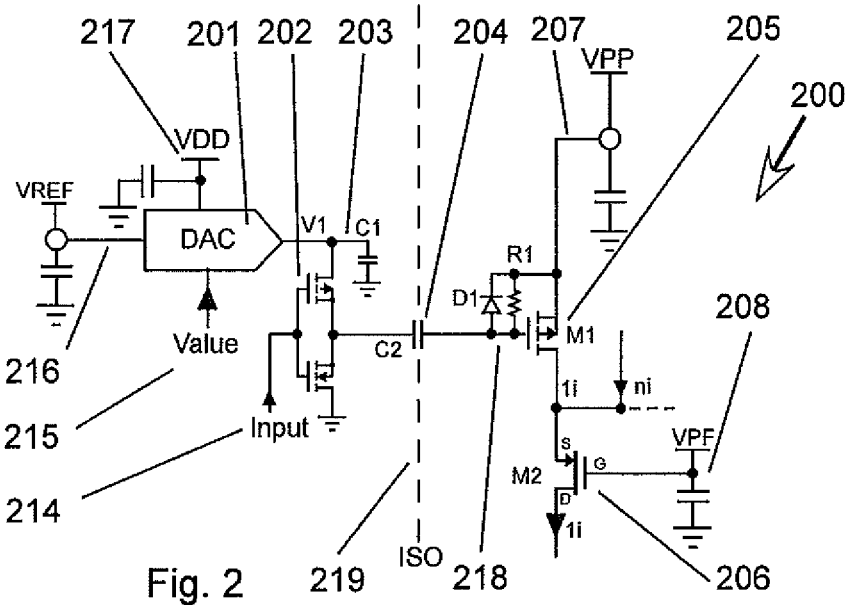
FIG. 2 is a schematic diagram illustrating a pulse amplitude modulated low-voltage gate driver circuit, of P-MOSFET side, using capacitive coupling method to cross the high voltage isolation barrier, connect to a "Pulse Amplitude Controlled Switching-Current-Source" (PACS), sending not only the precision high speed pulse timing control signal, but also including the pulse current-amplitude control information to high-side switching current source-driver, the source driver further connected to the source of the common-gate voltage amplifier.

Referring now to FIG. 2, a schematic block diagram illustrating the detail of the PACS circuit 200 (hereinafter circuit 200) of the present invention is shown. The circuit 200 has a P-type of source-driver and control circuit. In accordance with the present embodiment, the source-driver, the PACS circuit 205 & 218 and the low side gate driver 202 controlled by the DAC 201, The Gate driver and DAC input may have digital control signals from 214 and 215 according waveform inputs or memory.

A switching current control circuit PACS 205 may be as simple as a single low voltage P-MOSFET M1 coupled to the source of the common-gate power-amplifier depletion or enhance MOSFET M2 205. The switching current control circuit PACS 205 may also be an array of the PACS with different current weighting, like 1*i*, 2*i*, 4*i* . . . 128*i* for 8-bit resolution PACS, summed together and fed into one high voltage MOSFETs M2 206.

The bias voltage for the gate of the switching current control circuit PACS 205 may be supplied by voltage supply VPF 208, and with a bypass capacitor C1 coupled to the ground. The gate to source of the low voltage P-MOSFET M1 may have a DC-restoring circuit of 218. The DC-restoring circuit of 218 may be comprised of a diode or Zener-diode D1 in parallel with a resistor R1. In general, one may select the resistance value of the resistor R1 such the time constant is larger than the longest pulse width of that the pulse generator needs transmitting.

A high voltage capacitor C2 204 may serve as a coupling component across the isolation barrier 219 between the low voltage digital-circuit on the left to high voltage side circuit M1, M2 and etc. on the right.

This capacitor C2 204 across the isolation barrier, not only block the high voltage potential between the different circuits, but also sends the gate driving timing and current level information across the isolation barrier 219. In the case of multiple weight of low voltage P-MOSFETs M1 being used, then same number of multiple C2 204 capacitors will be used to connect the same number of multiple gate drivers output.

The gate driver circuit 202 can be comprised as simply as a pair of complementary MOSFETs M3 and M4, as shown in the embodiment of the present invention. The voltage power supply 203 of the gate driver circuit 202 may be controlled by a Digital-to-Analog Converter (DAC) 201. The power supply 203 also may be comprised with a decoupling capacitor C1. The decoupling capacitor C1 may provide the instantaneous demand of current from the power supply 203. Therefore the value to be selected should be large enough to supply the gate switching charges, and yet small enough to follow the programmable apodization value quick changes.

The DAC 201 may be powered by a voltage supply VDD 217. The voltage supply VDD 217 may provide a typical voltage of 3 to 12 V. The DAC 201 may have a resolution of 4 to 14 bits meeting the ultrasound beamforming system transmit focus amplitude-apodization needs.

The DAC 201 may be used for setting up the full-scale current of both digital switch control current in the digital switch current source 205. The DAC 201 may have an external pin for the input of the DAC reference voltage +VREF 216. The reference voltage can be built-in or external supplied. It may be used to determine the DAC 201 full-scale and resolution accuracy and stability. The voltage of the reference +VREF 216 may be within the 1.0 to 2.5V range normally.

Figure 3:
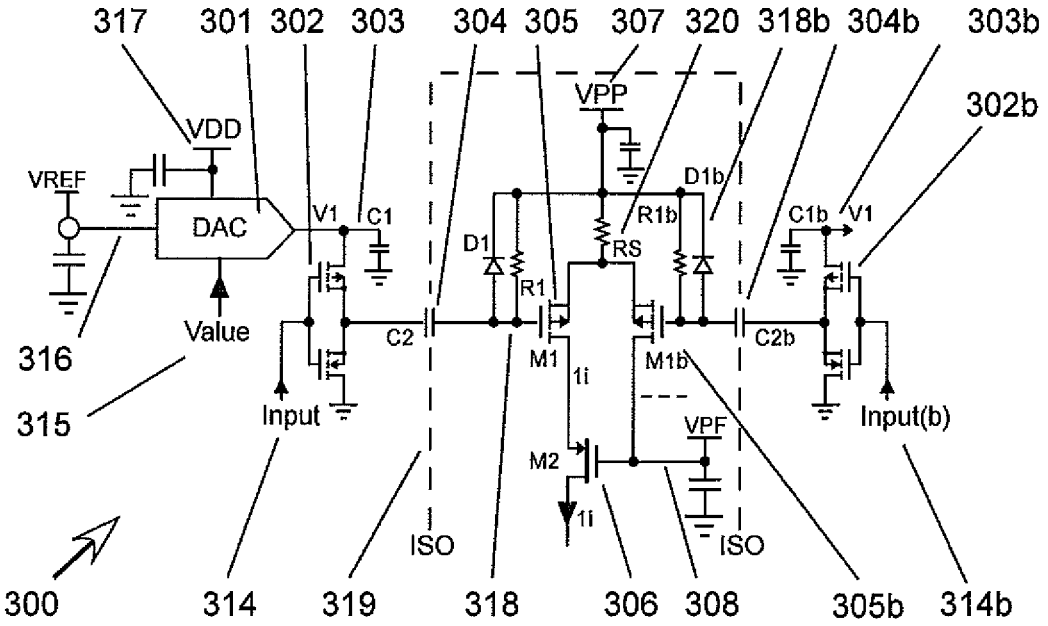
FIG. 3 is a differential implementation of the PACS circuit diagram.

Referring now to FIG. 3, a schematic block diagram illustrating the differential current switching PACS circuit 300 (hereinafter circuit 300) of the present invention is shown. The circuit 300 has an additional MOSFET M1*b* 305*b* coupled to the MOSFET M1 305. The MOSFETS M1305 and M1*b* 305*b* are connected together with their source terminals. A small resistor Rs may connect both source terminals of the MOSFETS M1305 and M1*b* 305*b* to power supply VPP 307 with a de-coupling capacitor C2 to the ground. The MOSFET M1*b* gate may have an additional gate coupling capacitor C2*b* across the isolation barrier, which may be driven by an additional gate driver 302*b*. The gate drivers 302 and 302B may be supplied from the same DAC controlled voltage V1. Because of the differential current switching configuration, the MOSFET M1*b* 305*b* drain current will feed into the power supply rail VPF 308 at the "idol" time, if the MOSFET M1*b* 305*b* is being turned on. The MOSFET M1 305 drain current may still feed into the MOSFET M2 306 source as the output. This configuration will reduce the drain voltages of MOSFETS M1 305 and M1*b* 305*b* less swing and keep the source of the MOSFETS M1 305 and M1*b* 305*b* more stable during the switching operation, thus making the whole circuit 300 quieter in switching noise.

Figure 4:
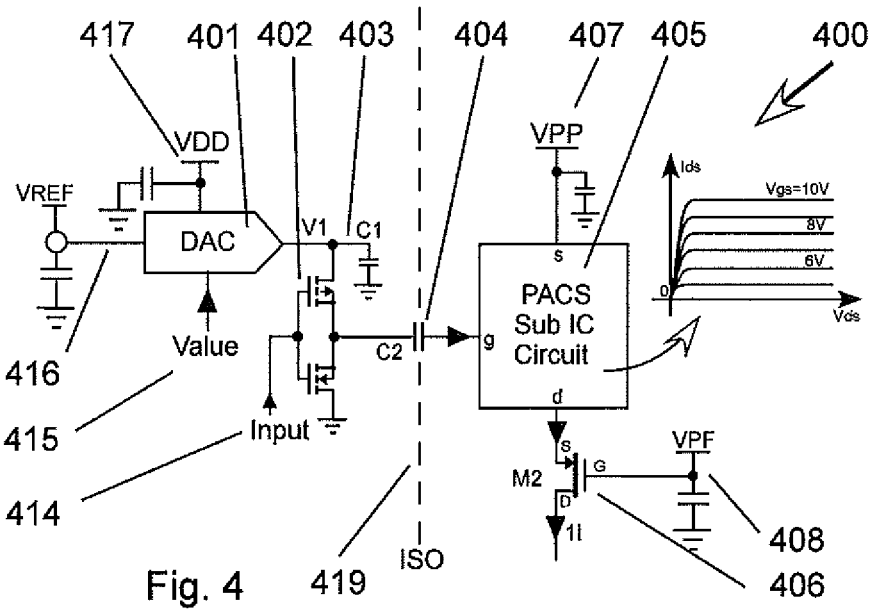
FIG. 4 is a schematic diagram illustrating the generalized using the variable pulse amplitude to send timing and amplitude information across the isolation barrier, by using the PACS circuit with linear or almost linear I-V curves.

Referring now to FIG. 4, a schematic block diagram illustrating a more general Pulse Amplitude Controlled Switching-Current-Source (PACS) circuit 400 (hereinafter circuit 400) of the present invention is shown. The circuit 400 has a PAC Sub-IC circuit 405 instead of a single P-MOSFET as the PACS. In accordance with one embodiment of the present embodiment, the PACS sub IC circuit 405 can be as simple as the MOSFET M1 205, a diode or Zener-diode D1 in parallel with a resistor R1 218 etc, or other various combinational MOSFETs cascode circuits to provide more linear or almost linear Vgs to Ids transfer function shown on the right I-V curves.

Figure 5:
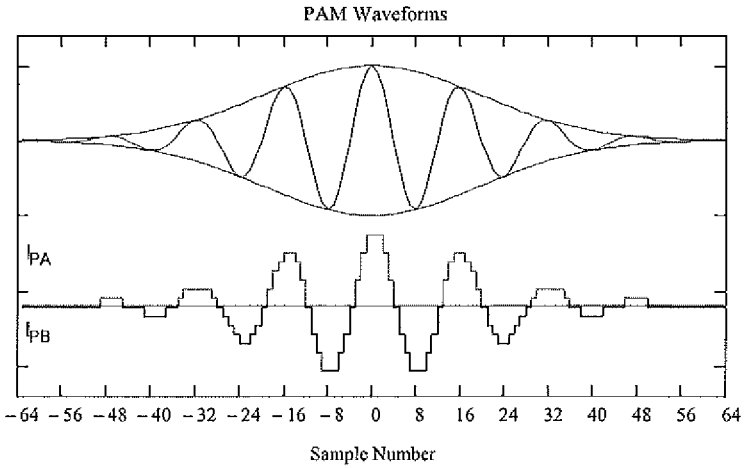
FIG. 5 is the typical waveforms the ultrasound beamforming transmit pulse-generator generated on the piezoelectric transducer load.

Referring now to FIG. 5, the pulse amplitude modulated current output waveform example can be generated from the circuit of the present invention is shown.

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. An electrical waveform generating circuit comprising:

a pair of Pulse Amplitude Controlled Switching Current Sources (PACS);

a gate pulse driver circuit coupled to an input of each of the pair of PACS for sending gate pulses for driving the pair of PACS;

a digital-to-analog converter (DAC) circuit coupled to the gate pulse driver circuit for controlling amplitudes of the gate pulses; and a transducer coupled to the PACS;

wherein the gate pulse driver circuit is configured to receive timing control signals that correspond to a weighting of the PACS.

2. The electrical waveform generating circuit of claim 1, further comprising a pair of amplifiers, wherein each amplifier is coupled to one of the PACS.

3. The electrical waveform generating circuit of claim 2, wherein the pair of amplifiers, are common gate amplifiers.

4. The electrical waveform generating circuit of claim 2, wherein the pair of amplifiers, comprises a P-MOSFET amplifier and an N-MOSFET amplifier, wherein the gate terminals of the P-MOSFET amplifier and an N-MOSFET amplifier are coupled to voltage supplies.

5. The electrical waveform generating circuit of claim 4, further comprising a pair of back-to-back coupled MOSFETs coupled to drain terminals of the P-MOSFET amplifier and an N-MOSFET amplifier.

6. The electrical waveform generating circuit of claim 5, further comprising a bleed resistor coupled to the back-to-back coupled MOSFETs.

7. The electrical waveform generating circuit of claim 1, further comprising a pair of cross coupled diodes coupled to the transducer.

8. An electrical waveform generating circuit comprising:

a programmable switch current source-driver;

a plurality of Pulse Voltage Amplitude Controlled Switching Current Source (PACS) configured into a high voltage complementary P- and N-type MOSFETs formed common-gate power amplifier;

a pair of complementary digital programmable voltage amplitude gate-driver capacitive circuits coupled to inputs of the PACS for controlling the output current waveforms and timing; and a transducer coupled to drains of the complementary P- and N-type MOSFETs.

9. The electrical waveform generating circuit in accordance with claim 8, wherein the programmable current source-driver comprises:

a pair of pulse voltage amplitude control switching current source drivers; and a low reference voltage power supply connected to each pulse voltage amplitude control switching current source driver as a bias voltage.

10. The electrical waveform generating circuit in accordance with claim 8 wherein the pair of complementary digital programmable voltage amplitude gate-driver capacitive circuits comprises:

a pair of positive and negative high voltage isolation-barriers for at least one of unidirectional and bidirectional control signals from at least one of to and from a digital circuit reference to ground; and differential high voltage AC signals supplied through a pair of capacitors, the capacitors coupled to the PACS.

11. The electrical waveform generating circuit in accordance with claim 8, further comprising a pair of digital to analog converters, wherein one of the pair of digital to analog converters is coupled to each of the pair of complementary digital programmable voltage amplitude gate-driver capacitive circuits.

12. The electrical waveform generating circuit in accordance with claim 11, wherein the digital to analog converters control a pulse voltage amplitude, and further control an output current level of the PACS.

13. An electrical waveform generating circuit comprising:

a pulse voltage amplitude control switching current source circuit;

a pair of switching control circuits coupled to a floating source-driver and control circuit;

a plurality of complementary P- and N-type MOSFETs coupled to the pair of switching control circuits; and a transducer coupled to the complementary P- and N-type MOSFETs.

14. An electrical waveform generating circuit in accordance with claim 13, wherein the plurality of complementary P- and N-type MOSFETs coupled to the switching control circuits comprises:

a P-type higher voltage, common gate MOSFET output circuits coupled to the pulse amplitude controlled switching current source circuit; and a N-type higher voltage, common gate MOSFET output circuits coupled to the pulse amplitude controlled switching current source circuit;

wherein a drain terminal of each of the pair of P-type MOSFET is coupled to a drain terminal of each of the pair of P-type MOSFET.

* * * * *